United States Patent [19]

Maunder

[11] 4,174,059

[45] Nov. 13, 1979

[54] BACK PACK

[76] Inventor: Martha Maunder, 475 W. Woods Rd., Hamden, Conn. 06514

[21] Appl. No.: 768,048

[22] Filed: Feb. 14, 1977

[51] Int. Cl.[2] ..... A45F 3/04

[52] U.S. Cl. ..... 224/209; 150/1; D3/32; D3/45

[58] Field of Search ..... 224/8 R, 9, 26 R, 5 R, 224/5 K, 5 P, 5 BC, 6, 11, 12; 150/1, 28 R; 190/52; 9/329, 330, 337, 339, 338, 340, 342, 345; D6/202; D34/2 C; D87/3 C, 1 R

[56] References Cited

U.S. PATENT DOCUMENTS

| | | | |
|---|---|---|---|
| D. 76,951 | 11/1928 | Palau | D87/3 C |
| 2,340,964 | 2/1944 | Kassner | 224/8 R |
| 2,961,668 | 11/1960 | Hayes | D6/202 |
| 3,931,917 | 1/1976 | Zellmer | 224/5 R |
| 4,057,854 | 11/1977 | Phelps | 224/9 X |

FOREIGN PATENT DOCUMENTS

| | | | |
|---|---|---|---|
| 227720 | 6/1943 | Switzerland | 224/8 R |
| 259417 | 6/1949 | Switzerland | 224/26 C |

*Primary Examiner*—Robert J. Spar
*Assistant Examiner*—Jerold M. Forsberg
*Attorney, Agent, or Firm*—DeLio and Montgomery

[57] ABSTRACT

A back pack which may be in the form of a four-limbed animal where the limbs provide straps to couple the pack to the wearer and also provide storage space.

2 Claims, 3 Drawing Figures

BACK PACK

This invention relates to carrying devices and more particularly relates to back packs.

At the present time, packs or equipment carried on the back of a wearer may comprise various types of containers which may be carried on a frame and the frame strapped to the wearer. Also, back packs may be in the more conventional form in which straps are attached about the body and shoulders of the wearer.

The present invention provides what may be termed a soft (non-rigid) back pack having increased storage capacity and a novel appearance, but may have a frame or other back support.

The invention in one form thereof comprises a three-dimensional fabric representation of an animal, insect or other creature and has a hollow body portion and hollow anterior and posterior legs. The legs are so arranged that an anterior and posterior leg on each side may be coupled either detachably or permanently to fit about the shoulders and under the arm of the wearer. At least two of the links are hollow and have openings defined therein adapted to receive articles to be stored. The body portion is also hollow and has openings therein also adapted to receive articles to be stored.

The features of the invention which are believed to be novel are particularly pointed out and distinctly claimed in the concluding portion of this specification. However, the invention both as to its organization, operation and method of practice together with further objects and advantages thereof may best be appreciated by reference to the following detailed description taken in conjunction with the drawings, wherein:

Figure 1:
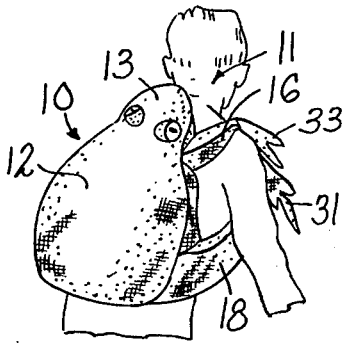
FIG. 1 is a view of a back pack embodying the invention mounted to the person of a wearer.
Figure 2:
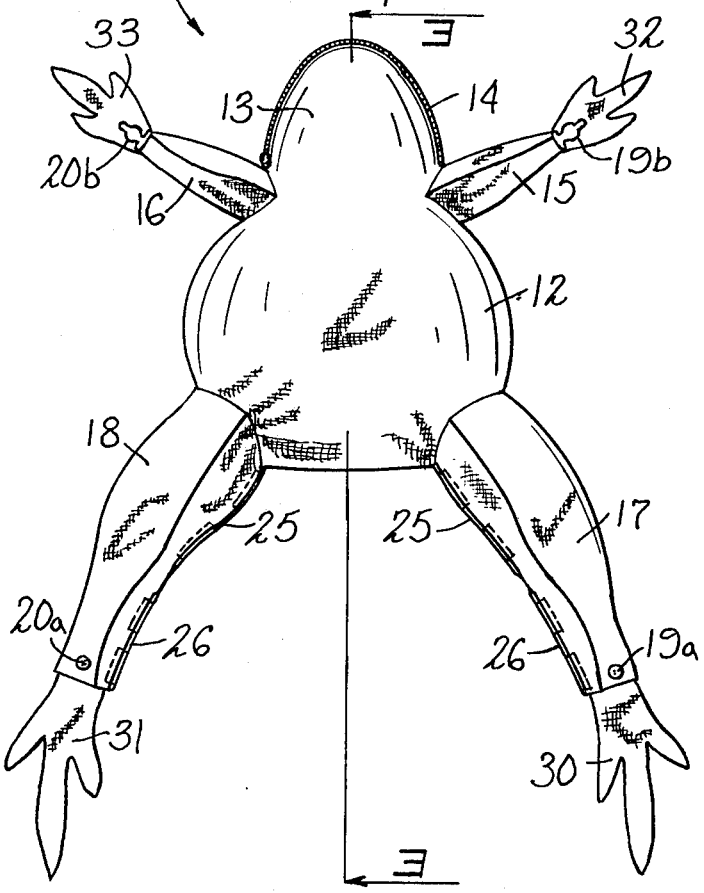
FIG. 2 is a view of the pack of FIG. 1 in a spread condition.
Figure 3:
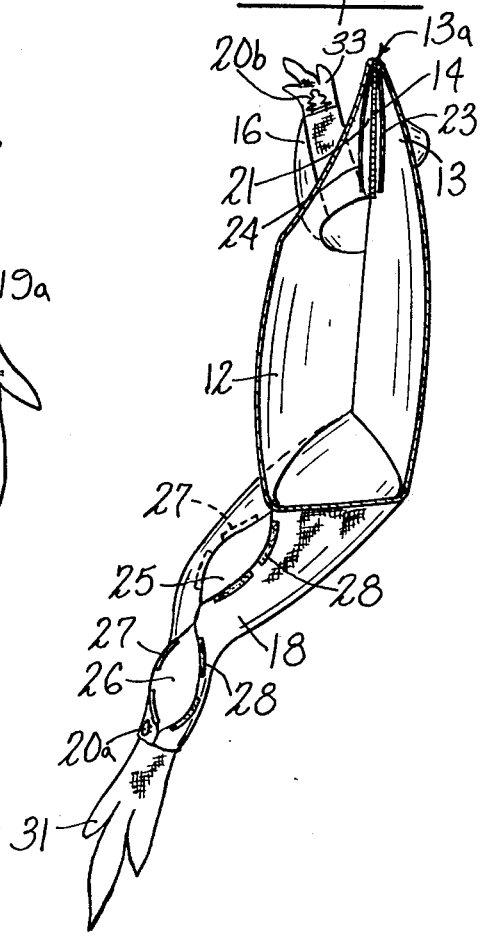
FIG. 3 is a view seen in the plane of lines 3—3 of FIG. 2.

A pack 10 adapted to be secured to the body of a wearer 11 is three-dimensional in shape and preferably is a representation of a four-limbed animal or creature. As shown, the pack is in the form of a frog having anterior and posterior legs extending from a body portion. A back storage or body portion 12 is hollow and defined by a fabric covering which may be canvas, or synthetic such as a fabric impregnated vinyl, or may be a pure plastic. As used herein the term "fabric" includes any type of sheet or web material which may be utilized to define the three-dimensional pack.

Body portion 12 includes a head portion 13 with an opening therein representing the mouth 13*a* of a frog which may be closed by an arcuate zipper 14. Extending from the upper part of body portion 12 are first strap portions defining anterior limbs 15 and 16. Extending from the bottom portion are second strap portions defining posterior limbs 17 and 18. The limbs of each side are provided with attachment means in the form of buttons 19*a*, 20*a* shown on the posterior limbs and mating hooks 19*b* and 20*b* on the anterior limbs. Hook 19*b* on anterior limb 15 is adapted to receive button 19*a* on posterior limb 17 and couple limb 15 over the shoulder to limb 17 under the shoulder. Any type of fastening means such as buckles and straps, or contact fastenings, such as "Velcro" fasteners may be utilized.

The opening 21 through the represented mouth 13*a* has closure means thereon in the form of the zipper 14 and lining members 23 and 24. Posterior limb 18 which is hollow has one or more closable openings 25 and 26 defined therein. Such openings as shown are closable by means of contact fasteners having portions 27 and 28 which secure upon contact and may be pulled open with a small amount of direct force. Alternatively, the openings 25 and 26 in each of the limbs may have zippers or buttons thereon to provide a closure means. A contact fastener of the type available under the name "Velcro" mentioned, supra., may also be used on the limb defining straps. The type of fastening means for the opening is not critical and any suitable or desired type may be made in the practice of the invention.

As shown, the posterior limbs 17 and 18 have ornamental feet 30 and 31 and the anterior limbs have ornamental feet 32 and 33, respectively, extending therefrom. Such ornamentation is not necessary to practice of the invention but is preferred for asthetic purposes.

As shown, both posterior legs are hollow for storage of articles or goods therein. The anterior arms are also hollow but depending upon the size thereof may or may not be utilized for storage. For appearance purposes, if not used for storage, the anterior limbs will normally have some filling or cushioning material therein to cushion the load on the shoulders, and also for appearance purposes.

If desired, only two of the strap providing limbs may be constructed for storage space, or all four depending on design. The first strap portions and second strap portions defined, as shown by the anterior and posterior limbs may be continuous, rather than detachable, and may be made to cross in front of the torso of the wearer.

It may thus be seen that the objects of the invention set forth as well as those made apparent from the foregoing description are efficiently attained. While a preferred embodiment of the invention has been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiment which do not depart from the spirit and scope of the invention.

What is claimed is:

1. A back pack having a hollow back storage portion adapted to reside on the back of a wearer and having a pair of flexible straps extending on either side of said back portion adapted to extend over the shoulders and under the arms of the wearer and secure the back pack to the wearer, a closable opening defined in said back storage portion, at least one of said straps of each of said pairs being hollow and having means defining closable openings thereinto for storage therein, and means for coupling together the straps to secure said back pack on a wearer, said back pack being in the form of a creature having a pair of anterior limbs and a pair of posterior limbs, said limbs forming said straps, said back portion defining the body of the creature.

2. The back pack of claim 1 wherein the opening into the body portion is through a defined mouth of the defined creature.

* * * * *